US011295659B2

(12) United States Patent
Lee et al.

(10) Patent No.: US 11,295,659 B2
(45) Date of Patent: Apr. 5, 2022

(54) DISPLAY DEVICE AND DRIVING METHOD THEREOF

(71) Applicant: Samsung Display Co., LTD., Yongin-si (KR)

(72) Inventors: Suk Hun Lee, Yongin-si (KR); So Hee Park, Yongin-si (KR); Chae Hee Park, Yongin-si (KR); Hyun Jun Lim, Yongin-si (KR); Jun Woo Son, Yongin-si (KR); Eun Ho Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1 day.

(21) Appl. No.: 16/867,820

(22) Filed: May 6, 2020

(65) Prior Publication Data

US 2020/0357327 A1 Nov. 12, 2020

(30) Foreign Application Priority Data

May 7, 2019 (KR) ..... 10-2019-0053274

(51) Int. Cl.
*G09G 3/20* (2006.01)

(52) U.S. Cl.
CPC ..... *G09G 3/2092* (2013.01); *G09G 2310/027* (2013.01); *G09G 2310/0267* (2013.01); *G09G 2310/0278* (2013.01)

(58) Field of Classification Search
CPC ..... G09G 3/2092; G09G 2310/0267; G09G 2310/027; G09G 2310/0278
See application file for complete search history.

(56) References Cited

U.S. PATENT DOCUMENTS

2018/0061913 A1 3/2018 Kim et al.
2018/0130423 A1* 5/2018 Kim ..... H01L 27/3262
2019/0244559 A1* 8/2019 Cho ..... G09G 3/32

FOREIGN PATENT DOCUMENTS

KR 10-2016-0147173 12/2016
KR 10-2018-0025531 3/2018
KR 10-2018-0050083 5/2018

* cited by examiner

*Primary Examiner* — Kenneth B Lee, Jr.
(74) *Attorney, Agent, or Firm* — H.C. Park & Associates, PLC

(57) ABSTRACT

Display device includes a scan driver to receive a scan start signal and to supply scan signals of a turn-on level to scan lines in response to the scan start signal; a data driver to receive grayscale values and to supply data voltages corresponding to the grayscale values and a reference data voltage to data lines; pixels connected to the scan lines and the data lines, the pixels including display target pixels configured to receive the data voltages and at least one sensing target pixel configured to receive the reference data voltage; and a scan start signal adjusting unit to detect the display target pixels among the pixels using the grayscale values and to adjust a phase of the scan start signal when at least one of the display target pixels comprises a sensing target pixel.

20 Claims, 14 Drawing Sheets

DISPLAY DEVICE AND DRIVING METHOD THEREOF

CROSS-REFERENCE TO RELATED APPLICATION

The application claims priority from and the benefit of Korean Patent Application No. 10-2019-0053274, filed on May 7, 2019, which is hereby incorporated by reference for all purposes as if fully set forth herein.

BACKGROUND

Field

Exemplary implementations of the invention relate to a display device and, more specifically, to a display device having at least one sensing target pixel and a driving method thereof.

Discussion of the Background

With the development of information technology, the importance of display devices, which are a connection medium between users and information, has been emphasized. In response to this, the use of display devices such as a liquid crystal display device, an organic light emitting display device, and a plasma display device has been increasing.

A display device may include pixels and display an image using a combination of light emitted from the pixels. Driving transistors included in each of the pixels may have different voltage-current characteristics due to process variations. For example, the driving transistors may have different threshold voltage values. Therefore, it is required to sense the threshold voltage values and in order to sense the threshold voltage values, sensing data voltage should apply to a sensing target pixel.

The above information disclosed in this Background section is only for understanding of the background of the inventive concepts, and, therefore, it may contain information that does not constitute prior art.

SUMMARY

Applicant realized that the sensing data voltage for sensing the threshold voltage value may not be supplied to the sensing target pixel when a supply time point of the sensing data voltage and a supply time point of a display data voltage overlap each other.

Display devices constructed according to the principles and exemplary implementations of the invention and driving methods thereof are capable of separating a supply time point of a sensing data voltage from that of a display data voltage.

Additional features of the inventive concepts will be set forth in the description which follows, and in part will be apparent from the description, or may be learned by practice of the inventive concepts.

According to one aspect of the invention, a display device includes: a scan driver to receive a scan start signal and to supply scan signals of a turn-on level to scan lines in response to the scan start signal; a data driver to receive grayscale values and to supply data voltages corresponding to the grayscale values and a reference data voltage to data lines; pixels connected to the scan lines and the data lines, the pixels including display target pixels configured to receive the data voltages and at least one sensing target pixel configured to receive the reference data voltage; and a scan start signal adjusting unit to detect display target pixels among the pixels using the grayscale values and to adjust a phase of the scan start signal when at least one of the display target pixels comprises a sensing target pixel.

The data driver may be configured to sequentially receive the grayscale values, and the scan start signal adjusting unit may include a counter, the counter may be configured to: count a scan line number every time the data driver receives the grayscale values in units of scan lines and provide a first scan line number corresponding to an initial display grayscale value exceeding a reference value among the grayscale values and a second scan line number corresponding to a last display grayscale value exceeding the reference value among the grayscale values.

The scan start signal adjusting unit may further include a comparator, the comparator may be configured to generate a phase adjustment signal when a sensing target scan line number corresponding to the sensing target pixel is greater than or equal to the first scan line number and less than or equal to the second scan line number.

The scan start signal adjusting unit may further include a phase adjuster, the phase adjuster may be configured to adjust a phase of the scan start signal when the phase adjuster receives the phase adjustment signal and maintaining the phase of the scan start signal when the phase adjuster does not receive the phase adjustment signal.

The data driver may be further configured to receive a sensing grayscale value of the sensing target pixel and the reference data voltage may correspond to the sensing grayscale value.

The data driver may be configured to receive the sensing grayscale value and display grayscale values at different time points within one image frame period.

The phase adjuster may be configured to adjust the phase of the scan start signal to a time point earlier than a previous phase when the phase adjuster receives the phase adjustment signal.

The data driver may be configured to receive the display grayscale values after receiving the sensing grayscale value.

The phase adjuster may be configured to adjust the phase of the scan start signal to a time point later than a previous phase when the phase adjuster receives the phase adjustment signal.

The data driver may be configured to receive the sensing grayscale value after receiving the display grayscale values.

Each of the pixels may include: a first transistor having a gate electrode connected to a first node, a first electrode connected to a first power supply line, and a second electrode connected to a second node; a second transistor having a gate electrode connected to a data scan line, a first electrode connected to the data line, and a second electrode connected to the first node; a third transistor having a gate electrode connected to an initialization scan line, a first electrode connected to the second node, and a second electrode connected to an initialization line; a storage capacitor having a first electrode connected to the first node and a second electrode connected to the second node; and a light emitting diode having an anode connected to the second node and a cathode connected to a second power supply line.

The initialization line may be connected to a sensing unit. The sensing unit may include: a reference voltage terminal; a capacitor; and an analog-to-digital converter connected to a first electrode of the capacitor. In a sensing period, the initialization line may be connected to the reference voltage terminal, and then to the first electrode of the capacitor.

The data driver may be configured to supply the reference data voltage within the sensing period.

According to another aspect of the invention, a driving method of a display device including a scan driver to receive a scan start signal and to supply scan signals of a turn-on level to scan lines in response to the scan start signal; a data driver to receive grayscale values and to supply data voltages corresponding to the grayscale values and a reference data voltage to data lines; and pixels connected to the scan lines and the data lines, the pixels including display target pixels configured to receive the data voltages and at least one sensing target pixel configured to receive the reference data voltage, the driving method comprising the steps of: detecting the display target pixels among the pixels using the grayscale values; confirming whether or not at least one of the display target pixels comprises the sensing target pixel; and adjusting a phase of the scan start signal when at least one of the display target pixels comprises the sensing target pixel.

The data driver may be configured to sequentially receive the grayscale values. The step of detecting the display target pixels may further include the steps of: counting a scan line number every time the data driver receives the grayscale values in units of scan lines; and providing a first scan line number corresponding to an initial display grayscale value exceeding a reference value among the grayscale values and a second scan line number corresponding to a last display grayscale value exceeding the reference value among the grayscale values.

The step of confirming may further include the step of generating a phase adjustment signal when a sensing target scan line number corresponding to the sensing target pixel is greater than or equal to the first scan line number and less than or equal to the second scan line number.

The step of adjusting the phase of the scan start signal may further include the steps of: adjusting a phase of the scan start signal when the phase adjustment signal is received; and maintaining the phase of the scan start signal when the phase adjustment signal is not received.

The data driver may be further configured to receive a sensing grayscale value of the sensing target pixel and supply a reference data voltage corresponding to the sensing grayscale value, and the data driver may be configured to receive the sensing grayscale value and display grayscale values at different time points within one image frame period.

The step of adjusting the phase of the scan start signal may further include the step of adjusting the phase of the scan start signal to a time point earlier than a previous phase when the phase adjustment signal is received, and the data driver may be configured to receive the display grayscale values after receiving the sensing grayscale value.

In the step of adjusting the phase of the scan start signal may further include the step of: adjusting the phase of the scan start signal to a time point later than a previous phase when the phase adjustment signal is received, and the data driver may be configured to receive the sensing grayscale value after receiving the display grayscale values.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
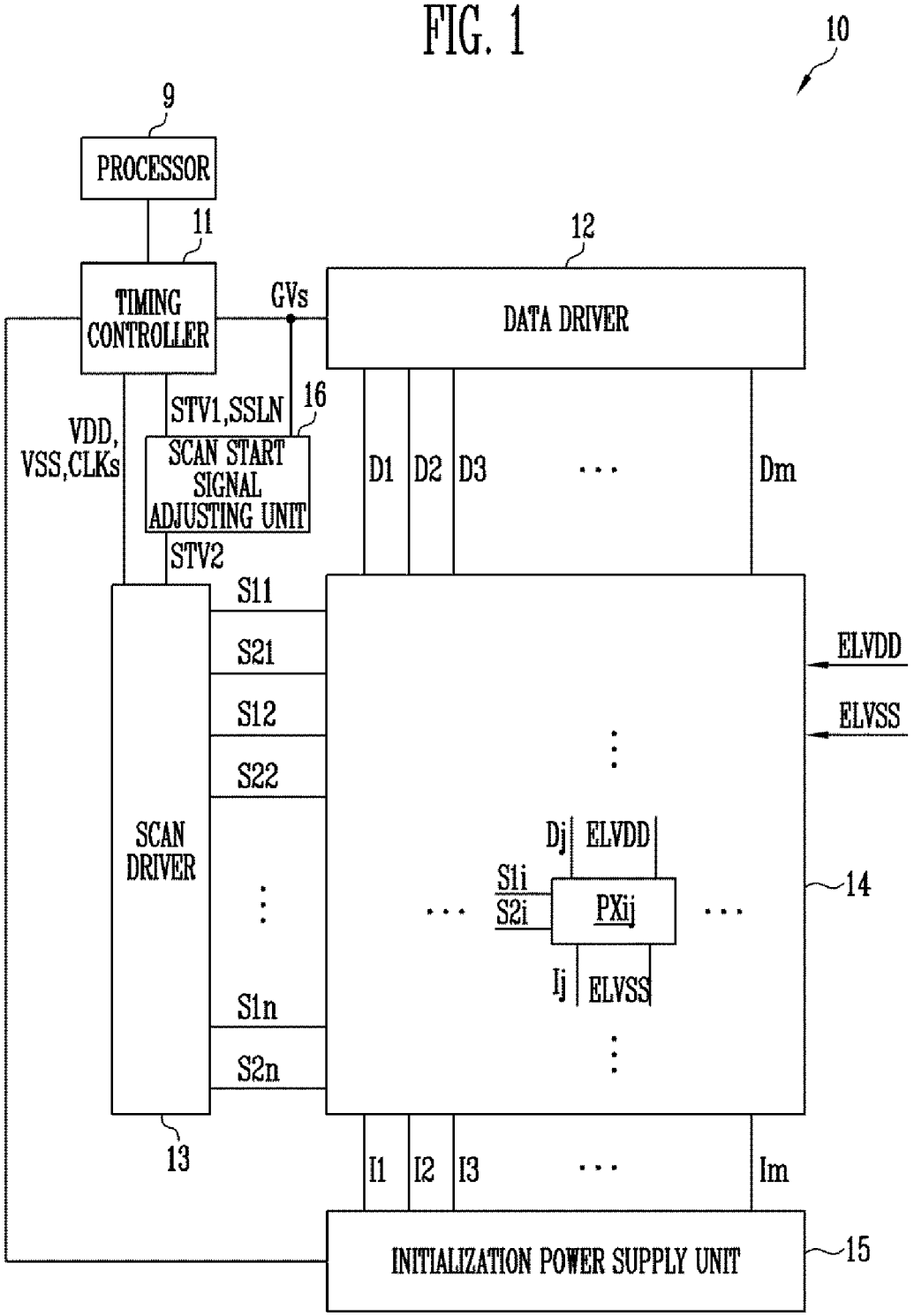
FIG. 1 is a block diagram of an exemplary embodiment of a display device constructed according to the principles of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of an exemplary embodiment of a display device constructed according to the principles of the invention.

Referring to FIG. 1, a display device 10 may include a processor 9, a timing controller 11, a data driver 12, a scan driver 13, a pixel unit 14, an initialization power supply unit 15, and a scan start signal adjusting unit 16.

The processor 9 may provide grayscale values for an image frame and control signals. The processor 9 may be an application processor, a central processing unit (CPU), a graphics processing unit (GPU), or the like.

The timing controller 11 may receive the grayscale values and the control signals from the processor 9. The timing controller 11 may convert the grayscale values and the control signals into signals suitable for the specification of the display device 10 and provide the signals to the data driver 12, the scan driver 13, the initialization power supply unit 15, and the scan start signal adjusting unit 16.

The data driver 12 may receive the grayscale values GVs and the control signals from the timing controller 11. The data driver 12 may supply data voltages corresponding to the grayscale values GVs to data lines D1, D2, D3, . . . , Dm, wherein m may be an integer greater than zero. For example, the grayscale values GVs may be represented by a digital value such as a binary number, and the data voltages may be represented by an analog value.

The scan driver 13 may receive clock signals CLKs, a high voltage VDD and a low voltage VSS from the timing controller 11 and receive a second scan start signal STV2 from the scan start signal adjusting unit 16. The scan driver 13 may supply scan signals of a turn-on level to scan lines S11,S12, . . . , S1*n* and S21, S22, . . . S2*n* corresponding to the second scan start signal STV2, wherein n may be an integer greater than zero. For example, the scan driver 13 may receive the second scan start signal STV2 and sequentially provide data scan signals of the turn-on level to data scan lines S11 to S1*n* after a predetermined time elapses so that a pixel row to which data voltages are to be written may be selected. In one exemplary embodiment, the scan driver 13 may receive the second scan start signal STV2 and sequentially provide initialization scan signals of a turn-on level to initialization scan lines S21 to S2*n* after a predetermined time elapses.

The pixel unit 14 may include pixels. Each pixel PXij may be connected to a data line Dj, a data scan line S1*i*, an initialization scan line S2*i*, and an initialization line Ij. In addition, each pixel PXij may be connected to a first power supply line ELVDD and a second power supply line ELVSS. For example, when the data voltages from the data driver 12 are applied to the data lines D1 to Dm, the data voltages may apply to the pixels supplied with the data scan signals of the turn-on level from the scan driver 13.

The initialization power supply unit 15 may supply an initialization voltage to initialization lines I1, I2, I3, . . . , Im. For example, the difference between the initialization voltage and a voltage applied to the second power supply line ELVSS may be lower than an emission threshold voltage of a light emitting diode of each pixel.

Figure 9:
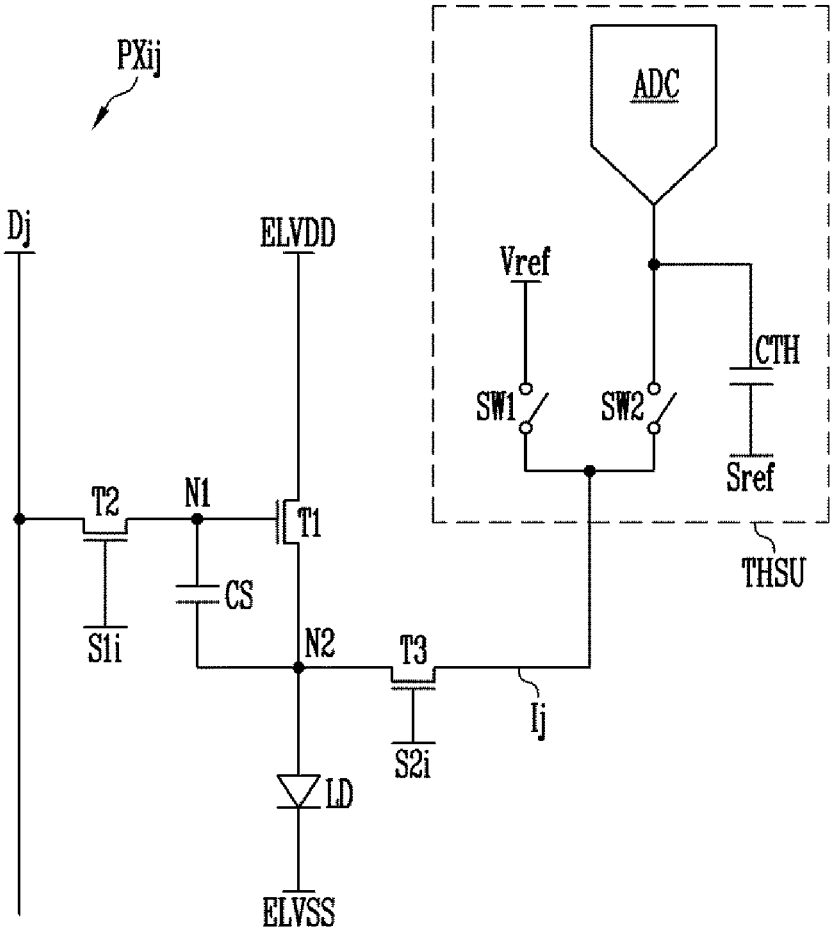
FIG. 9 is a circuit diagram of an exemplary embodiment of a sensing unit connecting to a sensing target pixel.

The display device 10 may further include a sensing unit THSU (refer to FIG. 9). When the initialization lines I1, I2, I3, . . . , Im operate as sensing lines, the sensing unit THSU may be included in the initialization power supply unit 15. In another exemplary embodiment, the sensing unit THSU may be separated from the initialization power supply unit 15.

The scan start signal adjusting unit 16 may receive a first scan start signal STV1, a sensing target scan line number SSLN, and the grayscale values GVs from the timing controller 11. The scan start signal adjusting unit 16 may detect display target pixels among the pixels using the grayscale values GVs and adjust a phase of the first scan start signal STV1 when at least one of the display target pixels comprises a sensing target pixel. For example, the scan start signal adjusting unit 16 may provide the scan driver 13 with the second scan start signal STV2 having a phase different from the phase of the first scan start signal STV1 supplied from the timing controller 11 when at least one of the display target pixels comprises the sensing target pixel. When at least one of the display target pixels does not coincide with the sensing target pixel, the scan start signal adjusting unit 16 may provide the scan driver 13 with the second scan start signal STV2 having the same phase as the first scan start signal STV1. That is, the first scan start signal STV1 and the second scan start signal STV2 may have the same signal level (e.g. the same amplitude) and may have the same or different phases. In other words, the phase difference between the first scan start signal STV1 and the second scan start signal STV2 may mean that the time point at which the scan start signal is supplied is different.

Figure 2:
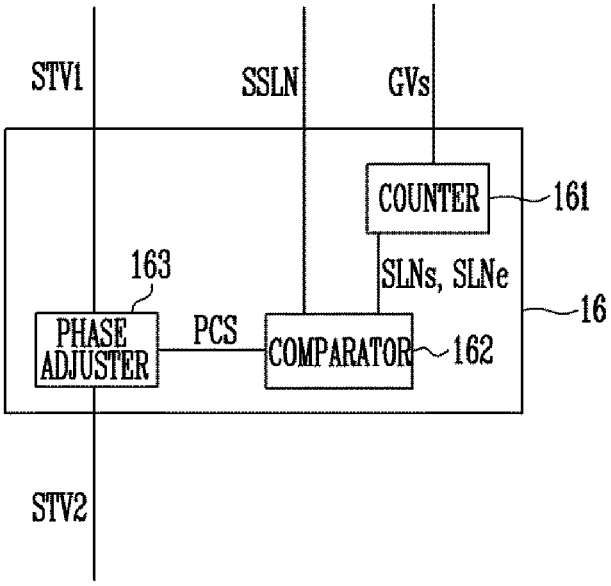
FIG. 2 is a block diagram of an exemplary embodiment of a scan start signal adjusting unit of FIG. 1

FIG. 2 is a block diagram of an exemplary embodiment of a scan start signal adjusting unit of FIG. 1.

Referring to FIG. 2, the scan start signal adjusting unit 16 may include a counter 161, a comparator 162, and a phase adjuster 163.

For example, the timing controller 11 may sequentially provide the grayscale values GVs to the data driver 12. The data driver 12 may sequentially receive the grayscale values GVs by sampling the grayscale values GVs using the clock signals or the like.

The counter 161 may count a scan line number every time the data driver 12 receives the grayscale values GVs in units of scan lines. The number of grayscale values GVs in units of scan lines may be equal to the number of pixels connected to one data scan line or one initialization scan line. For example, the description that a pixel is connected to a data scan line may mean that a gate electrode of a scan transistor of the pixel is connected to the data scan line. When 100 pixels are connected to each of the data scan lines, the number of grayscale values GVs in units of scan lines may be 100. In this case, the counter 161 may count the scan line number as 1 when the data driver 12 receives the 1st to 100th grayscale values GVs and count the scan line number as 2 when the data driver 12 receives the 101st to 200th grayscale values GVs.

The counter 161 may provide a first scan line number SLNs corresponding to an initial display grayscale value exceeding a reference value among the grayscale values GVs and a second scan line number SLNe corresponding to a last display grayscale value exceeding the reference value among the grayscale values GVs.

For example, each of the grayscale values GVs may range from 0 to 255. The value "0" may mean a darkest grayscale (for example, black grayscale), and the value "255" may mean a brightest grayscale (for example, white grayscale). The reference value may be zero.

For example, the grayscale values GVs corresponding to the scan line numbers smaller than the first scan line number SLNs may all be zero. At least some of the grayscale values GVs corresponding to the first scan line number SLNs may be greater than zero. Each of the grayscale values GVs corresponding to the scan line numbers that are larger than the first scan line number SLNs and smaller than the second scan line number SLNe may be any one of 0 to 255. At least some of the grayscale values GVs corresponding to the second scan line number SLNe may be larger than zero. The grayscale values GVs corresponding to the scan line numbers larger than the second scan line number SLNe may all be zero. In the exemplary embodiment, pixels corresponding to the grayscale values GVs corresponding to the first scan line number SLNs to the second scan line number SLNe may be defined as display target pixels.

That is, the counter 161 may detect the display target pixels among the pixels using the grayscale values GVs. Here, the grayscale values corresponding to the display target pixels among the grayscale values GVs may be defined as display grayscale values.

The comparator 162 may generate a phase adjustment signal PCS when the sensing target scan line number SSLN corresponding to the sensing target pixel is greater than or equal to the first scan line number SLNs and less than or equal to the second scan line number SLNe. The sensing target scan line number SSLN may be a scan line number to which the sensing target pixel is connected. For example, the sensing target scan line number SSLN may be the number of the data scan line to which the gate electrode of the scan transistor of the sensing target pixel is connected.

That is, the comparator 162 may detect whether or not at least one of the display target pixels comprises the sensing target pixel.

The phase adjuster 163 may adjust the phase of the first scan start signal STV1 to generate the second scan start signal STV2 when receiving a phase adjusting signal PCS from the comparator 162 and generate the second scan start signal STV2 having the same phase as the first scan start signal STV1 when not receiving the phase adjusting signal PCS from comparator 162.

That is, the phase adjuster 163 may adjust the phase of the first scan start signal STV1 when at least one of the display target pixels comprises the sensing target pixel and may maintain the phase of the first scan start signal STV1 when none of the display target pixels comprises the sensing target pixel.

When every display target pixel does not coincide with the sensing target pixel, even if the second scan start signal STV2 having the same phase as the first scan start signal STV1 is provided, the sensing pixel and any of the display pixels does not coincide with each other, so that display and sensing may be performed at the same time.

On the other hand, when at least one of the display target pixels comprises the sensing target pixel, the second scan start signal STV2 having the same phase as the first scan start signal STV1 is provided and at least one of the display pixels and the sensing pixel coincide with each other so that the display and the sensing may not be performed at the same time. According to the exemplary embodiment, when at least one of the display pixels comprises the sensing pixel, the second scan start signal STV2 having a phase different from that of the first scan start signal STV1 is provided, so that the display and the sensing may be performed at the same time.

In a frame for performing both the display and the sensing, the display target pixels mean pixels which are expected to emit light with a luminance corresponding to the display grayscale value when the first scan start signal STV1 is provided to the scan driver 13. In addition, the sensing target pixel means a pixel to which a reference data voltage corresponding to the sensing grayscale value is to be input when the first scan start signal STV1 is provided to the scan driver 13.

The display pixel means an actual pixel which emits light with a luminance corresponding to the display grayscale value by providing the second scan start signal STV2 to the scan driver 13. The sensing pixel means the actual pixel to which the reference data voltage corresponding to the sensing grayscale value is to be input by providing the second scan start signal STV2 to the scan driver 13.

Figure 3:
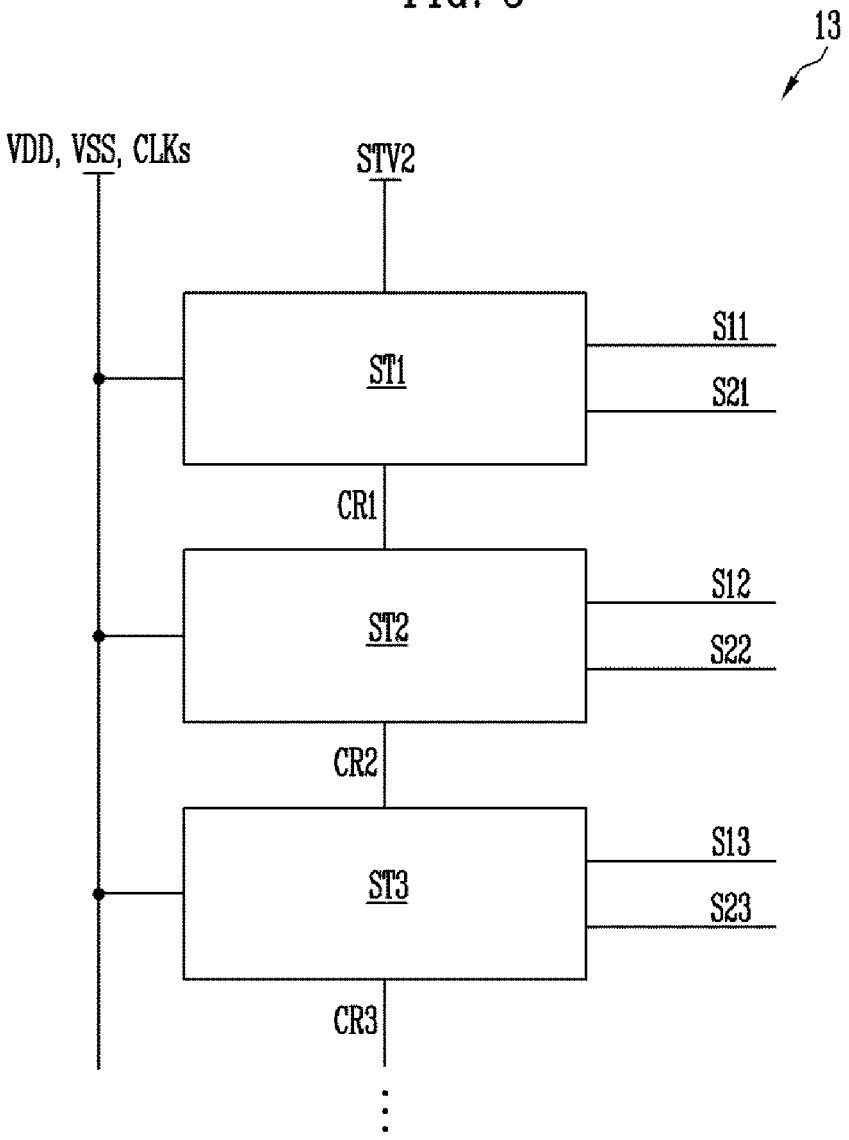
FIG. 3 is a block diagram of an exemplary embodiment of a scan driver of FIG. 1.

FIG. 3 is a block diagram of an exemplary embodiment of a scan driver of FIG. 1.

Referring to FIG. 3, the scan driver 13 may include a plurality of stages ST1, ST2, and ST3. The stages ST1, ST2, and ST3 may be configured with substantially the same circuit structure.

Each of the stages ST1, ST2, and ST3 may be provided with the clock signals CLKs, the high voltage VDD, and the low voltage VSS. In addition, each of the stages ST2 and ST3, except for the first stage ST1, may be supplied with a corresponding one of the carry signals CR1, CR2, and CR3 from the previous stage. Since the first stage ST1 has no previous stage, the second scan start signal STV2 may be provided from the scan start signal adjusting unit 16.

The stages ST1, ST2 and ST3 may supply the data scan signals to the data scan lines S11, S12 and S13 based on the clock signals CLKs and the carry signals CR1, CR2 and CR3, and supply the initialization scan signals to the initialization scan lines S21, S22, and S23, respectively. Accordingly, the stages ST1, ST2, and ST3 may sequentially supply the data scan signals and the initialization scan signals of a turn-on level.

The turn-on level may mean a voltage level at which a transistor to which the signal is applied to a gate electrode can be turned on. For example, if the transistor is an N-type (e.g., NMOS), the turn-on level may be a logic high level. If the transistor is a P type (e.g., PMOS), the turn-on level may be a logic low level. Hereinafter, it is assumed that the transistors are of N type. At this time, the turn-on level may be the logic high level.

For example, the scan driver 13 may receive the second scan start signal STV2 and sequentially provide the data scan signals of the turn-on level to the data scan lines S11, S12, and S13 after a predetermined time elapses, so that a pixel row to which the data voltages are to be written may be selected.

Similarly, the scan driver 13 may receive the second scan start signal STV2 and sequentially provide the initialization scan signals of the turn-on level to the initialization scan lines S21, S22, and S23 after a predetermined time elapses. At this time, the phase of the data scan signal of the turn-on level and the phase of the initialization scan signal of the turn-on level provided from the same stage ST1, ST2, or ST3 may be the same (refer to FIG. 5). For example, the data scan signal and the initialization scan signal supplied to the same pixel may have the same level and phase.

Figure 4:
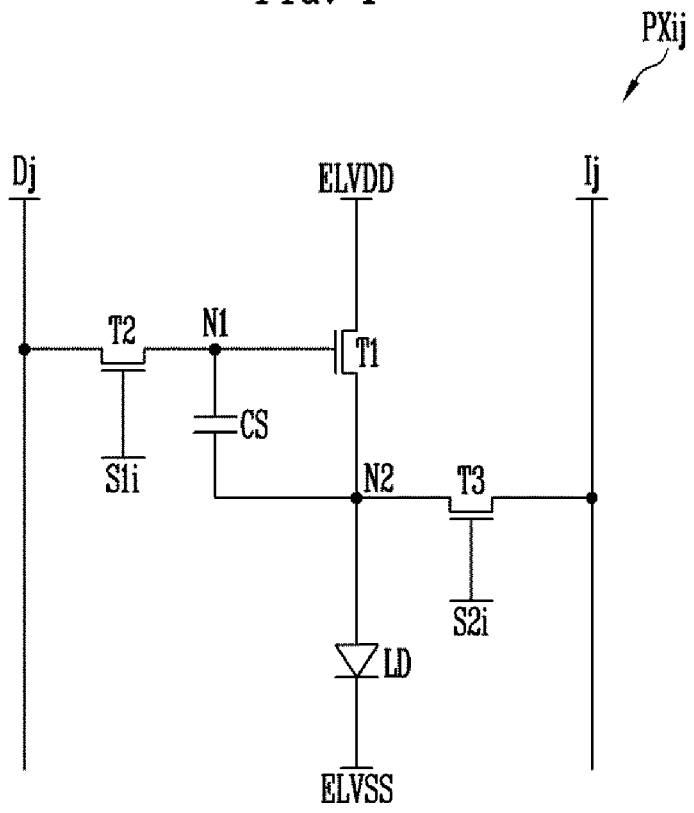
FIG. 4 is a circuit diagram of an exemplary embodiment of a representative pixel of FIG. 1.

FIG. 4 is a circuit diagram of an exemplary embodiment of a representative pixel of FIG. 1.

Referring to FIG. 4, the pixel PXij may include transistors T1, T2, and T3, a storage capacitor CS, and a light emitting diode LD.

The first transistor T1 may include a gate electrode connected to a first node N1, a first electrode connected to the first power supply line ELVDD, and a second electrode connected to a second node N2. The first transistor T1 may be referred to as a driving transistor.

The second transistor T2 may include a gate electrode connected to the data scan line S1*i*, a first electrode connected to the data line Dj, and a second electrode connected to the first node N1. The second transistor T2 may be referred to as a scan transistor, a switching transistor, or the like.

The third transistor T3 may include a gate electrode connected to the initialization scan line S2*i*, a first electrode connected to the second node N2, and a second electrode connected to the initialization line Ij. The third transistor T3 may be referred to as an initialization transistor, a sensing transistor, or the like.

The storage capacitor CS may include a first electrode connected to the first node N1 and a second electrode connected to the second node N2.

The light emitting diode LD may include an anode connected to the second node N2 and a cathode connected to the second power supply line ELVSS. The light emitting diode LD may be an organic light emitting diode, an inorganic light emitting diode, a quantum dot light emitting diode, or the like.

Here, i may be an integer greater than zero and j may be an integer greater than zero.

When the pixel PXij operates as a display pixel, a data scan signal of a turn-on level (for example, logic high level) may be applied to the data scan line S1*i* and an initialization scan signal of a turn-on level may be applied to the initialization scan line S2*i*. At this time, a data voltage corresponding to a grayscale value may be applied to the data line Dj and an initialization voltage may be applied to the initialization line Ij. The data voltage may be applied to the first node N1 through the second transistor T2 turned on in accordance with the data scan signal of the turn-on level. In addition, the initialization voltage may be applied to the second node N2 through the third transistor T3 turned on in accordance with the initialization scan signal of the turn-on level. In the exemplary embodiment, the difference between the initialization voltage and a voltage applied to the second power supply line ELVSS may be lower than an emission threshold voltage of the light emitting diode LD. Therefore, the light emitting diode LD may be in a non-light emitting state.

Next, a data scan signal of a turn-off level (for example, logic low level) may be applied to the data scan line S1*i*, and an initialization scan signal of a turn-off level may be applied to the initialization scan line S2*i*. The storage capacitor CS may maintain the voltage difference between the first node N1 and the second node N2. The first transistor T1 may control the amount of driving current flowing from the first power supply line ELVDD to the second power supply line ELVSS according to the voltage difference. The light emitting diode LD may emit light at a luminance corresponding to the amount of driving current.

Figure 5:
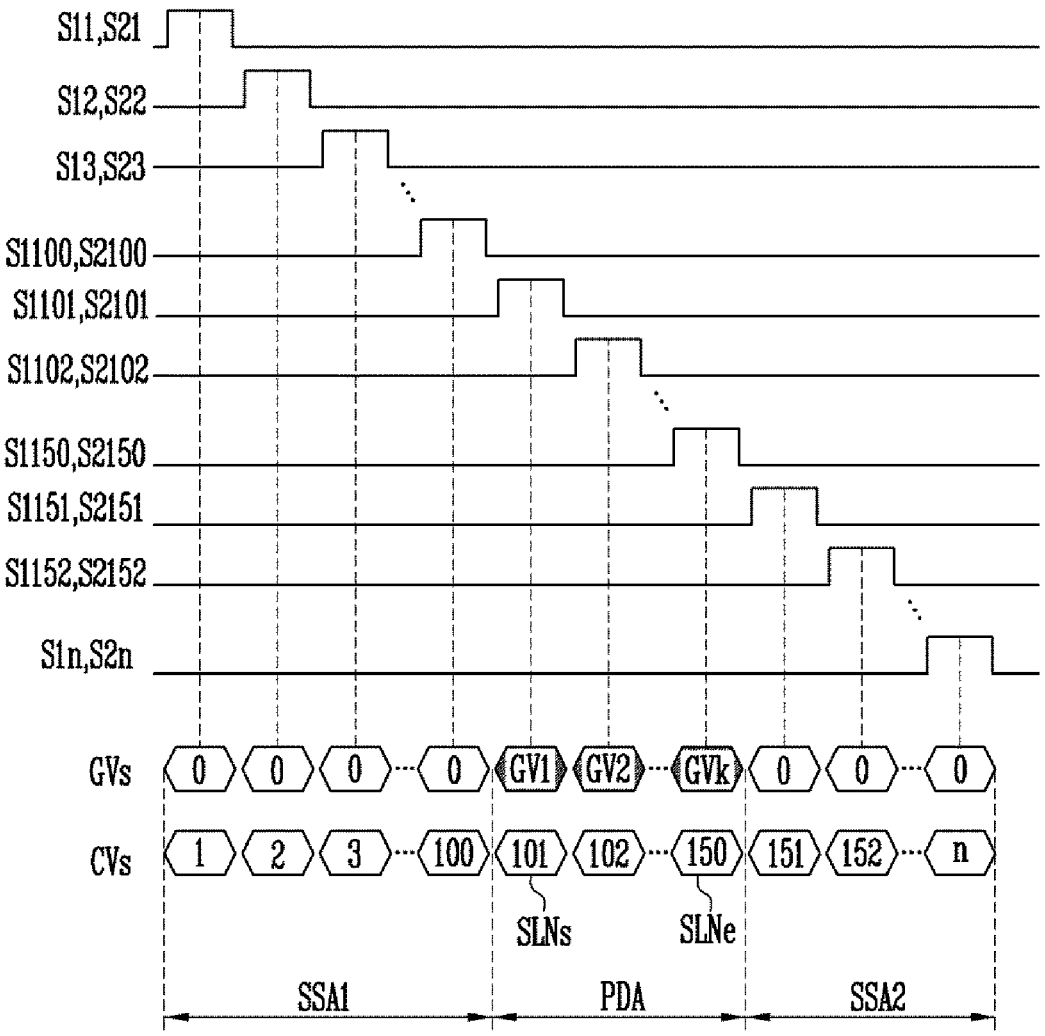
FIG. 5 is a timing chart of an exemplary embodiment of an operation of the scan start signal adjusting unit for detecting display target pixels.
Figure 6:
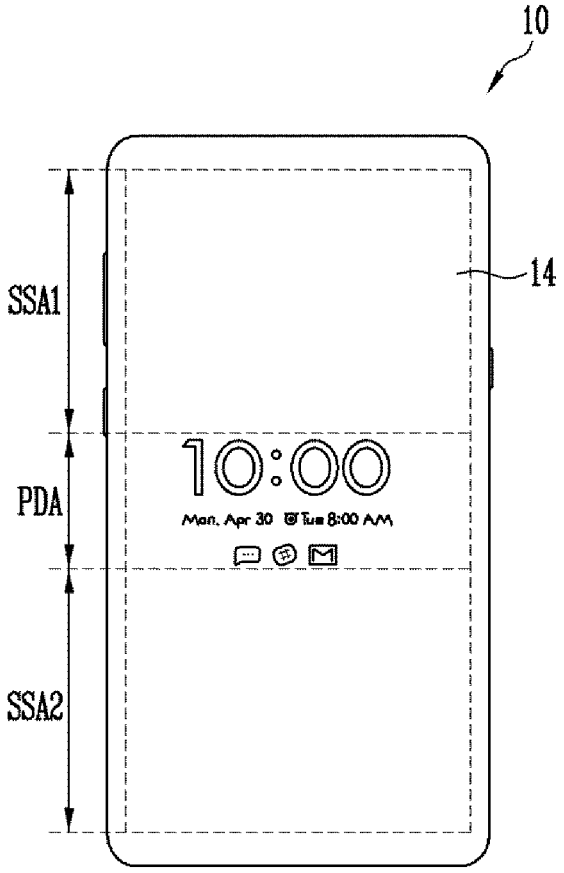
FIG. 6 is a diagram of an exemplary embodiment of a screen image corresponding to the operation of the scan start signal adjusting unit of FIG. 5.

FIG. 5 is a timing chart of an exemplary embodiment of an operation of the scan start signal adjusting unit for detecting display target pixels. FIG. 6 is a diagram of an exemplary embodiment of a screen image corresponding to the operation of the scan start signal adjusting unit for detecting display target pixels.

Referring to FIGS. 2 through 6, the scan start signal adjusting unit 16 may generate the second scan start signal STV2 in which the phase of the first scan start signal STV1 received from the timing controller 11 is maintained, and may supply the second scan start signal STV2 to the scan driver 13.

The scan driver 13 may sequentially supply the scan signals of the turn-on level (for example, logic high level) to the scan lines.

In FIG. 5, the grayscale values GVs are shown in units of scan lines. The grayscale values GVs indicated by 0 in FIG. 5 mean that the grayscale values GVs of the corresponding scan line number are all 0.

Count values CVs may be values at respective time points counted by the counter 161. For example, the counter 161 may determine a count value to be 1 when receiving the grayscale values (for example, all 0) corresponding to the first scan lines S11 and S21. The counter 161 may determine the count value to be 2 when receiving the grayscale values (for example, all 0) corresponding to the second scan lines S12 and S22. The counter 161 may determine the count value to be 3 when receiving the grayscale values (for example, all 0) corresponding to the third scan lines S13 and S23. Similarly, the counter 161 may determine the count value to be 100 when receiving the grayscale values (for example, all 0) corresponding to the 100th scan lines S1100 and S2100.

The counter 161 may determine the count value to be 101 when receiving grayscale values GV1 corresponding to the 101st scan lines S1101 and S2101. At this time, at least a part of the grayscale values GV1 may exceed a reference value (for example, 0). Therefore, the counter 161 may output 101 as the first scan line number SLNs.

Similarly, the counter 161 may determine the count value to be 150 when receiving the grayscale values GVk corresponding to the 150th scan lines S1150 and S2150. At this time, at least a part of the grayscale values GVk may exceed the reference value (for example, 0). When all of the grayscale values GVs are equal to 0, the counter 161 may output 150 as the second scan line number SLNe.

Referring to FIGS. 5 and 6, an area where pixels connected to the scan lines immediately before the first scan line numbers SLNs (for example, the 100th scan lines S1100 and S2100) from the first scan lines S11 and S211 are disposed may be referred to as a first sensing enabled area SSA1. An area where pixels connected to the scan lines corresponding to scan line numbers from the first scan line number SLNs to the second scan line number SLNe (for example, from the 101st scan lines S1101 and S2101 to the 150th scan lines S1150 and S2150) are disposed may be referred to as a partial display area PDA. The pixels of the partial display area PDA may be referred to as display target pixels. In addition, an area where pixels connected to the last scan lines S1*n* and S2*n* from the scan lines immediately after the second scan line number SLNe (for example, from the 151st scan lines S1151 and S2151 to the last scan lines S1*n* and S2*n*) are disposed may be referred to as a second sensing enabled area SSA2.

Figure 7:
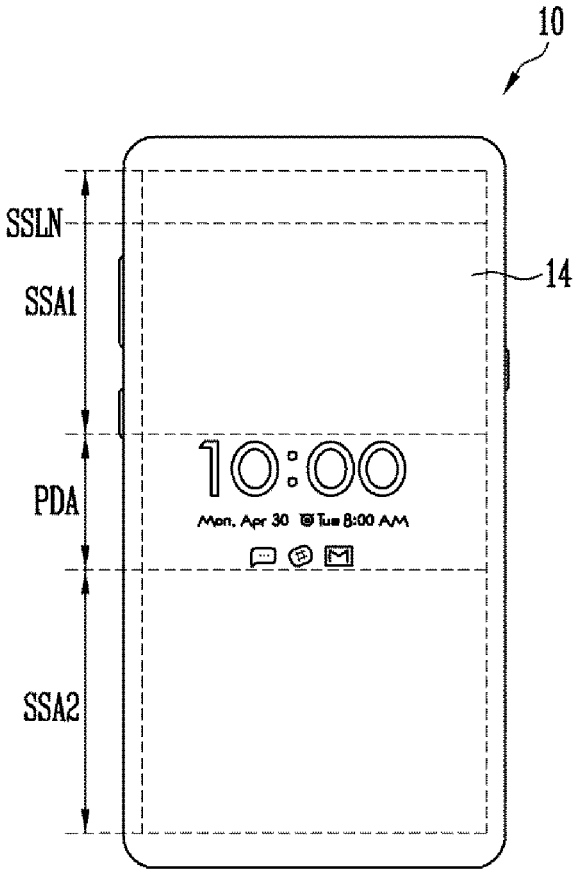
FIG. 7 is a diagram of an exemplary embodiment of a screen image corresponding to the operation of the scan start signal adjusting unit of FIG. 8.
Figure 8:
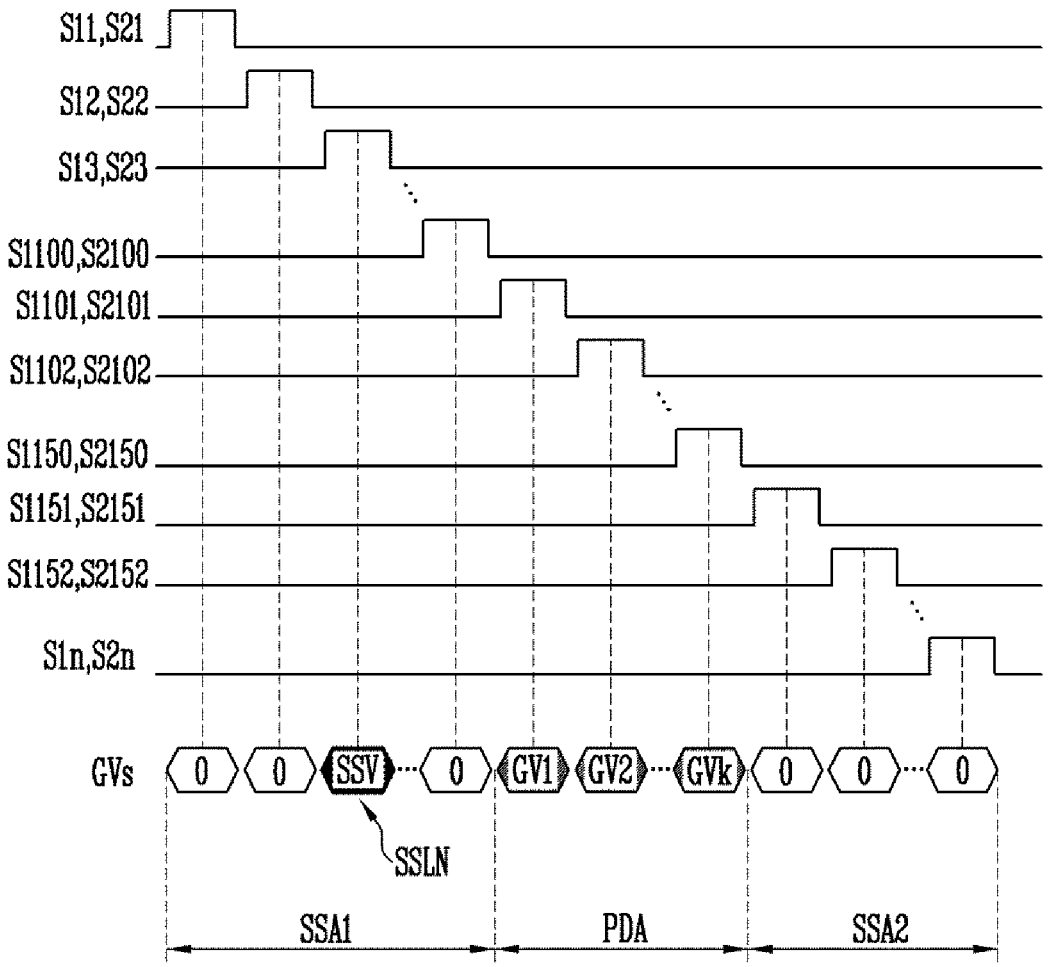
FIG. 8 is a timing chart of an exemplary embodiment of an operation of the scan start signal adjusting unit which does not adjust a phase of a scan start signal.

FIG. 7 is a diagram for explaining a case where a scan start signal adjusting unit does not adjust a phase of a scan start signal. FIG. 8 is a timing chart for explaining a case where a scan start signal adjusting unit does not a adjust phase of a scan start signal. Specifically, FIG. 7 is a diagram of an exemplary embodiment of a screen image corresponding to the operation of the scan start signal adjusting unit of FIG. 8, and FIG. 8 is a timing chart of an exemplary embodiment of an operation of the scan start signal adjusting unit which does not adjust a phase of a scan start signal.

Referring to FIGS. 7 and 8, the comparator 162 may receive the sensing target scan line number SSLN from the timing controller 11 and receive the first scan line number SLNs and the second scan line number SLNe from the counter 161.

In FIGS. 7 and 8, the sensing target scan line number SSLN is less than the first scan line number SLNs. That is, the comparator 162 may determine that a sensing target scan line is located in the first sensing enabled area SSA1. Therefore, the comparator 162 does not generate the phase adjustment signal PCS.

The phase adjuster 163 may generate the second scan start signal STV2 that maintains the phase of the first scan start signal STV1. The scan driver 13 may generate the scan signals at the same timing (for example, one frame basis) as shown in FIG. 5.

At this time, the timing controller 11 may supply the data driver 12 with a sensing grayscale value SSV at the timing corresponding to the sensing target scan line number SSLN. The data driver 12 may receive the sensing grayscale value SSV and the display grayscale values GV1, GV2, . . . GVk at different time points within one image frame period. In this case, the sensing grayscale value SSV may be received earlier than the display grayscale values GV1, GV2, . . . , and GVk.

Figure 10:
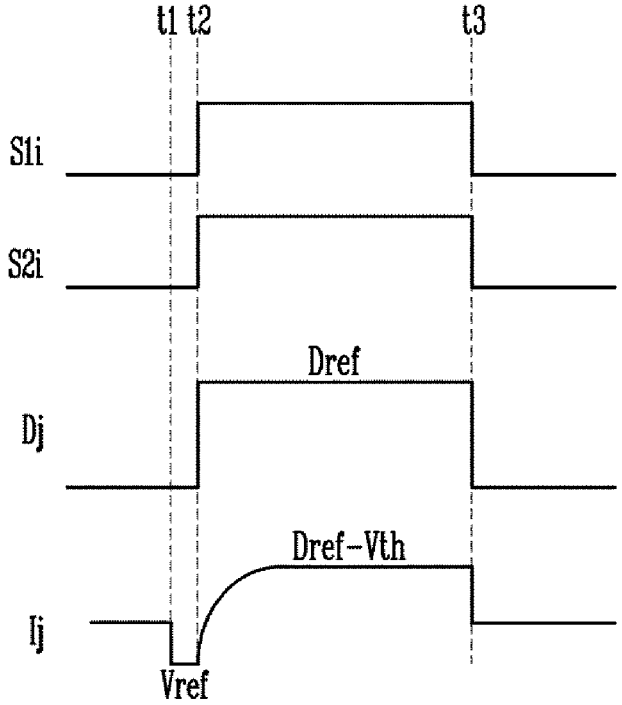
FIG. 10 is a timing chart of an exemplary embodiment of an operation of the sensing unit shown in FIG. 9.

FIG. 9 is a circuit diagram for explaining an operation of sensing the characteristics of a sensing target pixel. FIG. 10 is a timing chart for explaining an operation of sensing the characteristics of a sensing target pixel. Specifically, FIG. 9 is a circuit diagram of an exemplary embodiment of a sensing unit connecting to a sensing target pixel, and FIG. 10 is a timing chart of an exemplary embodiment of an operation of the sensing unit shown in FIG. 9.

A case where the pixel PXij is a sensing target pixel will be described as an example.

The data driver 12 may further receive the sensing grayscale value SSV from the timing controller 11 for the sensing target pixel PXij and further supply a reference data voltage Dref corresponding to the sensing grayscale value SSV to the data lines.

Referring to FIG. 9, the sensing unit THSU may include a reference voltage terminal Vref, a capacitor CTH, and an analog-to-digital converter ADC.

A reference voltage Vref may be applied to the reference voltage terminal. For example, the reference voltage terminal may be connected to the initialization line Ij when a switch SW1 is turned on.

The capacitor CTH may include a first electrode connected to the analog-to-digital converter ADC and a second electrode to which a sustain reference voltage Sref is applied. For example, the sustain reference voltage Sref may be a ground voltage. For example, the first electrode of the capacitor CTH may be connected to the initialization line Ij when the switch SW2 is turned on.

In a sensing period, the initialization line Ij may be first connected to the reference voltage terminal Vref, and then the initialization line Ij may be connected to the first electrode of the capacitor CTH. Hereinafter, this will be described in more detail with reference to FIG. 10.

First, the switch SW1 may be turned on at a first time point t1. Thus, the reference voltage terminal is connected to the initialization line Ij, and the initialization line Ij may be discharged to the reference voltage Vref.

Next, the switch SW2 may be turned on at a second time point t2. Thus the initialization line Ij may be connected to the first electrode of the capacitor CTH.

In addition, a data scan signal and an initialization scan signal of a turn-on level may be applied to the data scan line S1*i* and the initialization scan line S2*i*. At this time, the reference data voltage Dref may be applied to the data line Dj. Also, the voltage of the second node N2 may rise from the reference voltage Vref to a voltage Dref-Vth.

When the voltage of the second node N2 rises to the voltage Dref-Vth, the voltage of the second node N2 does not rise because the first transistor T1 is turned off.

At this time, the analog-to-digital converter ADC may calculate the threshold voltage value Vth of the first transistor T1 by receiving the voltage of the first electrode of the capacitor CTH in which the voltage of the second node N2 is written. At this time, the reference data voltage Dref may be a known value.

A data scan signal and the initialization scan signal of a turn-off level may be applied to the data scan line S1*i* and the initialization scan line S2*i* at a third time point t3. A period (for example, an interval between the second time point t2 and the third time point t3) during which the data scan signal and the initialization scan signal of the turn-on level are applied to a sensing pixel may be longer than a period during which the data scan signal and the initialization scan signal of the turn-on level are applied to the display pixel. The interval between the second time point t2 and the third time point t3 may be determined by adjusting the clock signals CLKs shown in FIG. 3. Accordingly, the time required for raising the voltage of the second node N2 in the sensing period can be secured.

Figure 11:
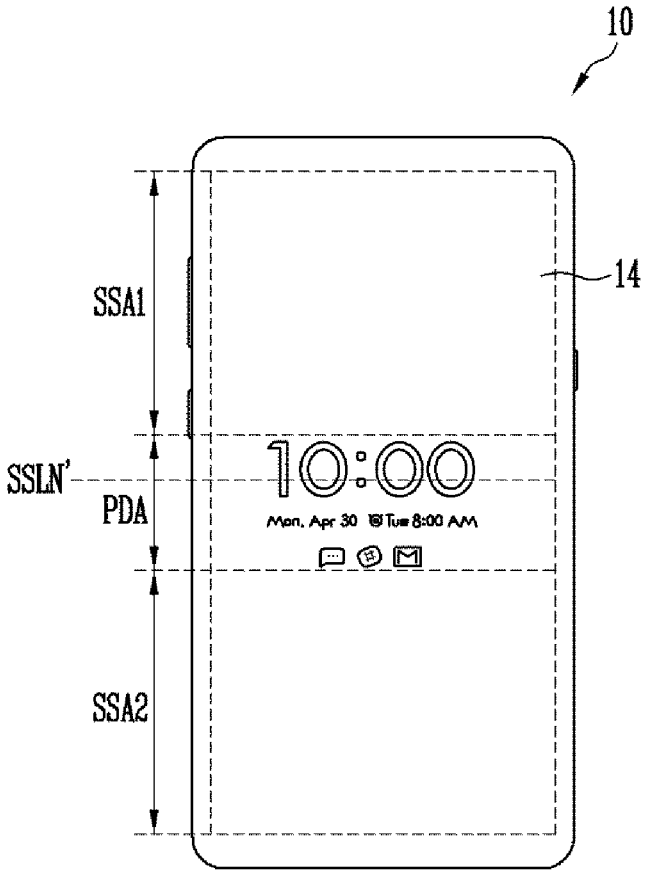
FIG. 11 is a diagram of an exemplary embodiment of a screen image corresponding to the operation of the scan start signal adjusting unit of FIG. 12.
Figure 12:
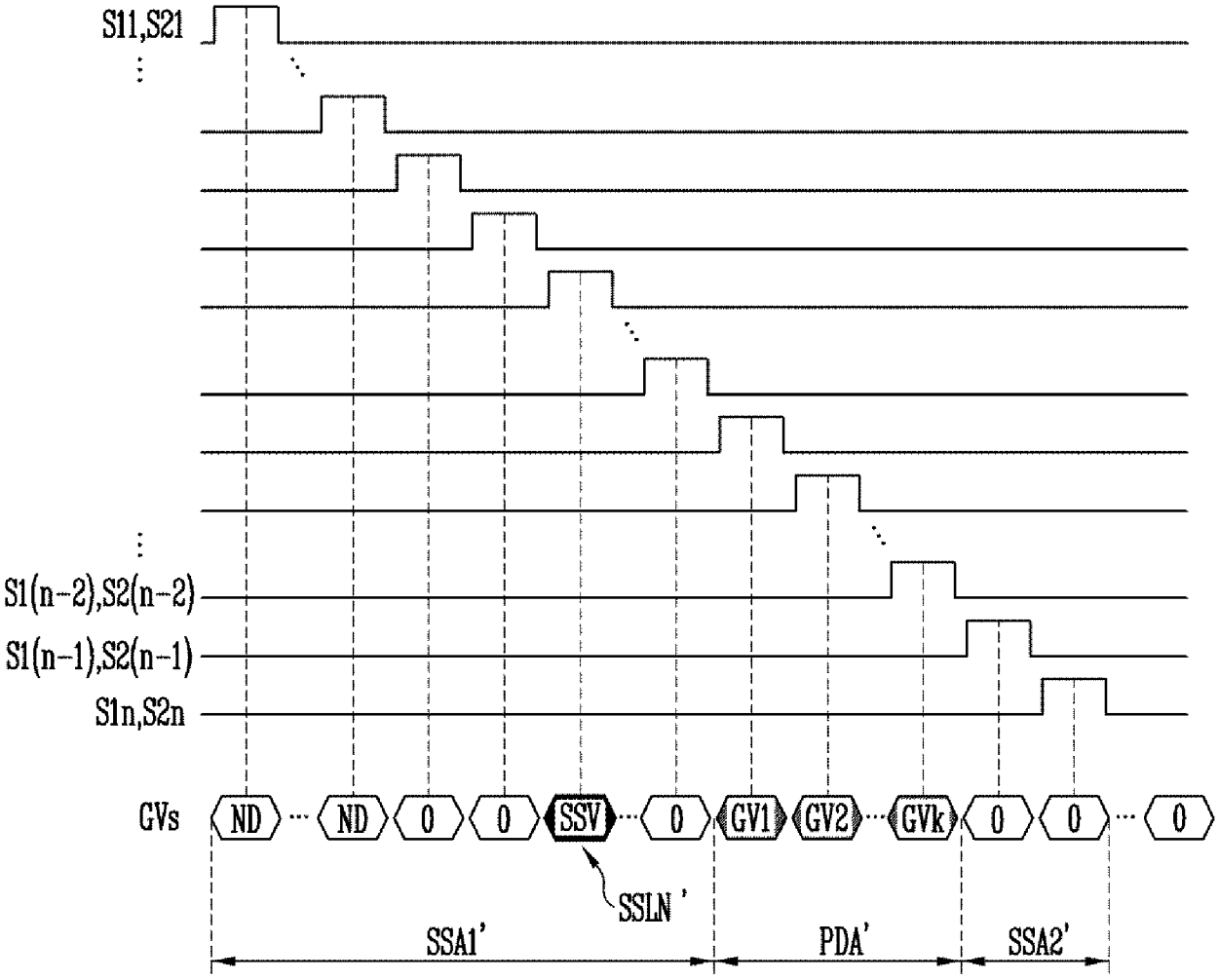
FIG. 12 is a timing chart of an exemplary embodiment of an operation of the scan start signal adjusting unit which adjusts a phase of a scan start signal to a time point earlier than the previous phase.
Figure 13:
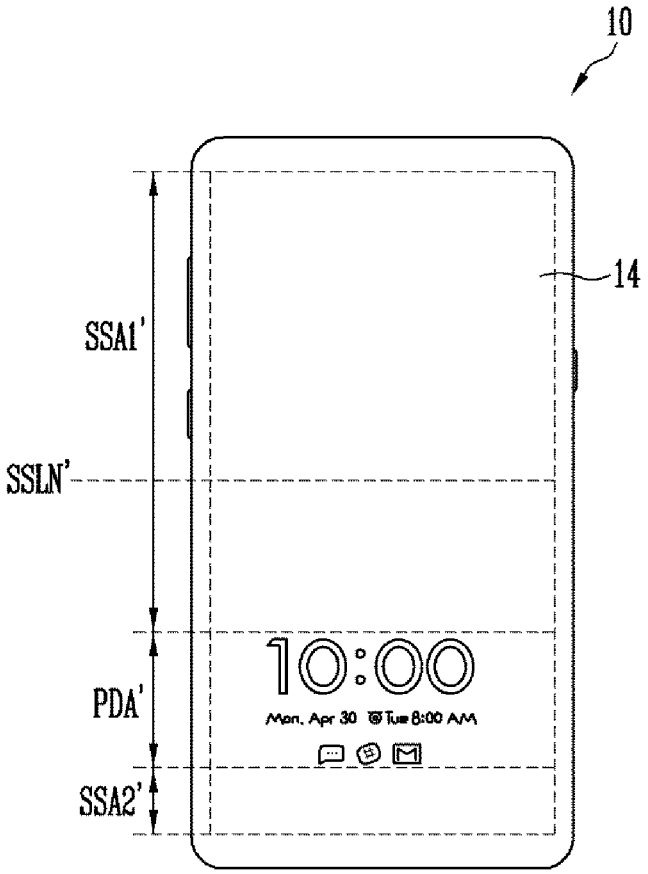
FIG. 13 is a diagram of an exemplary embodiment of a screen image corresponding to the operation of the scan start signal adjusting unit of FIG. 12.

FIGS. 11 and 13 are diagrams for explaining a case where a scan start signal adjusting unit adjusts a phase of a scan start signal to a time point earlier than the previous phase. Specifically, FIGS. 11 and 13 are diagrams of an exemplary embodiment of a screen image corresponding to the operation of the scan start signal adjusting unit of FIG. 12, and FIG. 12 is a timing chart of an exemplary embodiment of an operation of the scan start signal adjusting unit which adjusts a phase of a scan start signal to a time point earlier than the previous phase.

Referring to FIG. 11, a case where the sensing target scan line number SSLN' corresponds to one of the scan line numbers of the partial display area PDA is shown. That is, the sensing target scan line number SSLN' may be greater than or equal to the first scan line number SLNs and less than or equal to the second scan line number SLNe. As described above, in this case, the comparator 162 may generate the phase adjustment signal PCS and output the phase adjustment signal PCS to the phase adjuster 163.

The phase adjuster 163 may generate the second scan start signal STV2 in which the phase of the first scan start signal STV1 is adjusted to a time point earlier than the previous phase when the phase adjustment signal PCS is received. That is, the second scan start signal STV2 may be adjusted to be applied at an earlier time point than the first scan start signal STV1. The scan signals and the grayscale values GVs for this case are illustratively shown in FIGS. 12 and 13.

Since the second scan start signal STV2 has the phase earlier than the first scan start signal STV1, the data scan signals and the initialization scan signals of the turn-on level may be generated faster than in the case shown in FIG. 8. Accordingly, the grayscale values GVs corresponding to the first scan lines S11 and S21 may be newly required. Therefore, the timing controller 11 may further provide the data driver 12 with a temporary grayscale value ND before providing the previous grayscale values GVs (refer to FIG. 8). For example, the temporary grayscale value ND may be 0, and the pixels connected to the first scan line S11 and S21 may display a black grayscale.

The data driver 12 may receive the display grayscale values GV1, GV2, . . . , GVk after receiving the sensing grayscale value SSV.

Referring to FIGS. 12 and 13, the display grayscale value GV1, GV2, . . . , GVk may be displayed in the pixel unit 14 later than in the case shown in FIG. 7, thereby a partial display area PDA' may be located in a lower portion of the screen as shown in FIG. 13. Further, referring to FIG. 13, when compared with the case shown in FIG. 7, a first sensing enable area SSA1' becomes larger and a second sensing enable area SSA2' becomes smaller. At this time, the size of the partial display area PDA' may be maintained.

According to the exemplary embodiment, even if at least some of the display target pixels coincide with the sensing target pixel, since the display target pixels and other display pixels are determined by the scan start signal adjusting unit 16, the display pixels may be distinguished from the sensing pixel. Accordingly, display and sensing may be performed at the same time in one image frame.

Figure 14:
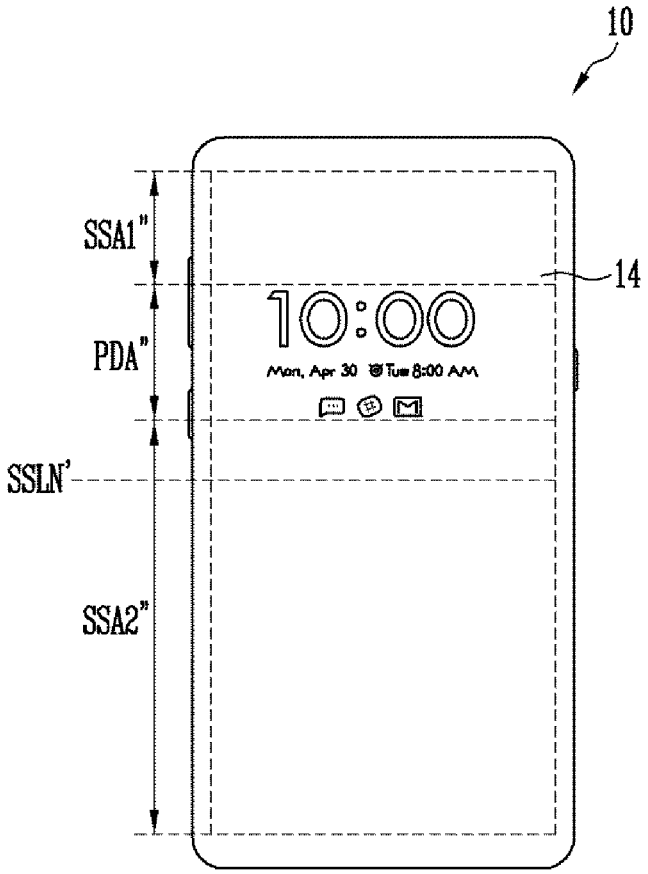
FIG. 14 is a diagram of an exemplary embodiment of a screen image corresponding to the operation of the scan start signal adjusting unit which adjusts a phase of a scan start signal to a time point slower than the previous phase.

FIG. 14 is a diagram for explaining a case where a scan start signal adjusting unit adjusts a phase of a scan start signal to a time point slower than the previous phase. That is, FIG. 14 is a diagram of an exemplary embodiment of a screen image corresponding to the operation of the scan start signal adjusting unit which adjusts a phase of a scan start signal to a time point slower than the previous phase.

In FIG. 11, when the phase adjustment signal PCS is provided, the phase adjuster 163 may adjust the phase of the first scan start signal STV1 to a time point that is later than the previous phase to generate the second scan start signal STV2.

Since the phase of the second scan start signal STV2 is later than that of the first scan start signal STV1, the data scan signals and the initialization scan signals of the turn-on level may be generated later than in the case shown in FIG. 8. Accordingly, the grayscale values GVs corresponding to the nth scan lines S1*n* and S2*n* may be required. Therefore, the timing controller 11 may further provide the data driver 12 with the temporary grayscale value ND after providing the previous grayscale values GVs (refer to FIG. 8). For example, the temporary grayscale value ND may be 0, and the pixels connected to the nth scan line S1*n* and S2*n* may display a black grayscale.

The data driver 12 may receive the sensing grayscale value SSV after receiving the display grayscale values GV1, GV2, . . . , GVk.

Accordingly, the display grayscale values GV1, GV2, . . . , GVk may be displayed on the display portion 14 earlier than in the case shown in FIG. 7. Compared with the case shown in FIG. 7, a first sensing enable area SSA1" becomes smaller and a second sensing enable area SSA2" becomes larger. At this time, the size of a partial display area PDA" may be maintained.

According to the exemplary embodiment, even if at least some of the display target pixels coincide with the sensing target pixel, since the display target pixels and other display pixels are determined by the scan start signal adjusting unit 16, the display pixels may be distinguished from the sensing pixel. Accordingly, display and sensing may be performed at the same time in one image frame.

Figure 15:
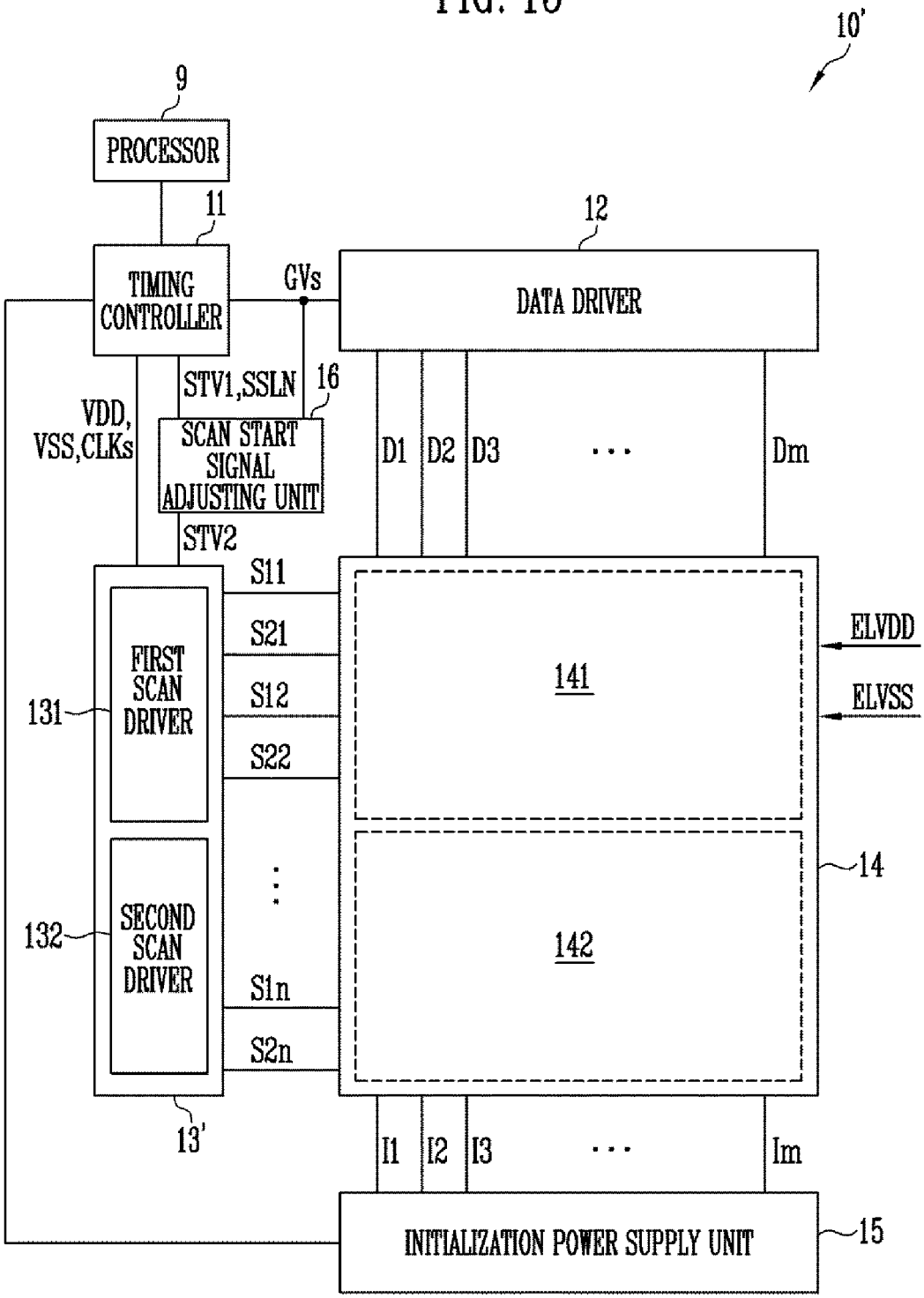
FIG. 15 is a block diagram of another exemplary embodiment of a display device constructed according to the principles of the invention.

FIG. 15 is a block diagram of another exemplary embodiment of a display device constructed according to the principles of the invention.

A display device 10' of FIG. 15 differs from the display device 10 of FIG. 1 in that a scan driver 13' includes a first scan driver 131 and a second scan driver 132. Since the remaining configuration of the display device 10' is substantially the same as that of the display device 10, a duplicate description will be omitted.

The first scan driver 131 may provide the data scan signals and the initialization scan signals to first pixels corresponding to a first pixel region 141 of the pixel unit 14.

The second scan driver 132 may provide the data scan signals and the initialization scan signals to second pixels corresponding to a second pixel region 142 of the pixel unit 14. The second pixel region 142 and the first pixel region 141 are adjacent to each other but may not overlap with each other. That is, the first pixels and the second pixels may be different from each other.

According to the exemplary embodiment, the scan start signal adjusting unit 16 may supply the second scan start signals STV2 to the first scan driver 131 and the second scan driver 132, respectively.

For example, when the sensing target scan line number SSLN corresponds to the scan line of the first pixel region 141 and the first scan line number SLNs and the second scan line number SLNe correspond to the scan lines of the second pixel region 142, the scan start signal adjusting unit 16 may provide the first scan driver 131 with the second scan start signal STV2 having the same phase as the first scan start signal STV1. Therefore, sensing may be performed in the first pixel region 141. In this case, the scan start signal adjusting unit 16 may provide the second scan start signal STV2 having a phase different from the first scan start signal STV1 to the second scan driver 132. Thus, deterioration due to image sticking of the partial display region of the second pixel region 142 in a standby mode can be prevented.

In another exemplary embodiment, when the sensing target scan line number SSLN corresponds to the scan line of the second pixel region 142 and the first scan line number SLNs and the second scan line number SLNe correspond to the scan lines of the first pixel region 141, the scan start signal adjusting unit 16 may provide the second scan driver 132 with the second scan start signal STV2 having the same phase as the first scan start signal STV1. Therefore, sensing may be performed in the second pixel region 142. In this case, the scan start signal adjusting unit 16 may provide the second scan start signal STV2 having a phase different from the first scan start signal STV1 to the first scan driver 131. Thus, deterioration due to image sticking of the partial display region of the first pixel region 141 in a standby mode can be prevented.

According to the above exemplary embodiments, the scan start signal adjusting unit 16 may separate the sensing pixel and the display pixel without feeding back the information about the sensing target pixel to the processor 9. That is, the information related to the grayscale values GVs provided in the processor 9 has not changed.

In another exemplary embodiment, the grayscale values GVs may be changed by feeding back the information about the sensing target pixel to the processor 9. In this case, the scan start signal adjusting unit 16 becomes unnecessary, but a feedback line to be connected to the processor 9 may be needed. In addition, an operation similar to the scan start signal adjusting unit 16 may be required in the processor 9.

The display device and the driving method thereof according to the exemplary embodiment of the invention may separate the supply time point of the sensing data voltage from the supply time point of the display data voltage.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a scan driver to receive a scan start signal and to supply scan signals of a turn-on level to scan lines in response to the scan start signal;

a data driver to receive grayscale values and to supply data voltages corresponding to the grayscale values and a reference data voltage to data lines;

pixels connected to the scan lines and the data lines, the pixels including display target pixels configured to receive the data voltages and at least one sensing target pixel configured to receive the reference data voltage; and a scan start signal adjusting unit to detect the display target pixels among the pixels using the grayscale values and to adjust a phase of the scan start signal when at least one of the display target pixels comprises the sensing target pixel.

2. The display device of claim 1, wherein the data driver is configured to sequentially receive the grayscale values, and wherein the scan start signal adjusting unit includes a counter, the counter is configured to:

count a scan line number every time the data driver receives the grayscale values in units of scan lines, and provide a first scan line number corresponding to an initial display grayscale value exceeding a reference value among the grayscale values and a second scan line number corresponding to a last display grayscale value exceeding the reference value among the grayscale values.

3. The display device of claim 2, wherein the scan start signal adjusting unit further includes a comparator, the comparator is configured to generate a phase adjustment signal when a sensing target scan line number corresponding to the sensing target pixel is greater than or equal to the first scan line number and less than or equal to the second scan line number.

4. The display device of claim 3, wherein the scan start signal adjusting unit further includes a phase adjuster, the phase adjuster is configured to adjust a phase of the scan start signal when the phase adjuster receives the phase adjustment signal and maintaining the phase of the scan start signal when the phase adjuster does not receive the phase adjustment signal.

5. The display device of claim 4, wherein the data driver is further configured to receive a sensing grayscale value of the sensing target pixel, and wherein the reference data voltage corresponds to the sensing grayscale value.

6. The display device of claim 5, wherein the data driver is configured to receive the sensing grayscale value and display grayscale values at different time points within one image frame period.

7. The display device of claim 6, wherein the phase adjuster is configured to adjust the phase of the scan start signal to a time point earlier than a previous phase when the phase adjuster receives the phase adjustment signal.

8. The display device of claim 7, wherein the data driver is configured to receive the display grayscale values after receiving the sensing grayscale value.

9. The display device of claim 6, wherein the phase adjuster is configured to adjust the phase of the scan start signal to a time point later than a previous phase when the phase adjuster receives the phase adjustment signal.

10. The display device of claim 9, wherein the data driver is configured to receive the sensing grayscale value after receiving the display grayscale values.

11. The display device of claim 1, wherein each of the pixels includes:

a first transistor having a gate electrode connected to a first node, a first electrode connected to a first power supply line, and a second electrode connected to a second node;

a second transistor having a gate electrode connected to a data scan line, a first electrode connected to the data line, and a second electrode connected to the first node;

a third transistor having a gate electrode connected to an initialization scan line, a first electrode connected to the second node, and a second electrode connected to an initialization line;

a storage capacitor having a first electrode connected to the first node and a second electrode connected to the second node; and a light emitting diode having an anode connected to the second node and a cathode connected to a second power supply line.

12. The display device of claim 11, wherein the initialization line is connected to a sensing unit, wherein the sensing unit includes:

a reference voltage terminal;

a capacitor; and an analog-to-digital converter connected to a first electrode of the capacitor, wherein in a sensing period, the initialization line is connected to the reference voltage terminal, and then to the first electrode of the capacitor.

13. The display device of claim 12, wherein the data driver is configured to supply the reference data voltage within the sensing period.

14. A driving method of a display device comprising a scan driver to receive a scan start signal and to supply scan signals of a turn-on level to scan lines in response to the scan start signal, a data driver to receive grayscale values and to supply data voltages corresponding to the grayscale values and a reference data voltage to data lines, and pixels connected to the scan lines and the data lines, the pixels including display target pixels configured to receive the data voltages and at least one sensing target pixel configured to receive the reference data voltage, the driving method comprising the steps of:

detecting the display target pixels among the pixels using the grayscale values;

confirming whether or not at least one of the display target pixels comprises the sensing target pixel; and adjusting a phase of the scan start signal when at least one of the display target pixels comprises the sensing target pixel.

15. The driving method of claim 14, wherein the data driver is configured to sequentially receive the grayscale values, and wherein the step of detecting the display target pixels further comprises the steps of:

counting a scan line number every time the data driver receives the grayscale values in units of scan lines; and providing a first scan line number corresponding to an initial display grayscale value exceeding a reference value among the grayscale values and a second scan line number corresponding to a last display grayscale value exceeding the reference value among the grayscale values.

16. The driving method of claim 15, wherein the step of confirming further comprises the step of generating a phase adjustment signal when a sensing target scan line number corresponding to the sensing target pixel is greater than or equal to the first scan line number and less than or equal to the second scan line number.

17. The driving method of claim 16, wherein the step of adjusting the phase of the scan start signal further comprises the steps of:

adjusting a phase of the scan start signal when the phase adjustment signal is received; and maintaining the phase of the scan start signal when the phase adjustment signal is not received.

18. The driving method of claim 17, wherein the data driver is further configured to receive a sensing grayscale value of the sensing target pixel and supply a reference data voltage corresponding to the sensing grayscale value, and wherein the data driver is configured to receive the sensing grayscale value and display grayscale values at different time points within one image frame period.

19. The driving method of claim 18, wherein the step of adjusting the phase of the scan start signal further comprises the step of:

adjusting the phase of the scan start signal to a time point earlier than a previous phase when the phase adjustment signal is received, and wherein the data driver is configured to receive the display grayscale values after receiving the sensing grayscale value.

20. The driving method of claim 18, wherein the step of adjusting the phase of the scan start signal further comprises the step of:

adjusting the phase of the scan start signal to a time point later than a previous phase when the phase adjustment signal is received, and wherein the data driver is configured to receive the sensing grayscale value after receiving the display grayscale values.

* * * * *